United States Patent [19]

Langdon

[11] Patent Number: 4,745,432

[45] Date of Patent: May 17, 1988

[54] LIQUID INK FUSING SYSTEM

[75] Inventor: Michael J. Langdon, Pittsford, N.Y.

[73] Assignee: Xerox Corporation, Stamford, Conn.

[21] Appl. No.: 8,987

[22] Filed: Jan. 30, 1987

[51] Int. Cl.[4] ..... G03G 15/20

[52] U.S. Cl. ..... 355/3 FU; 219/216; 34/155; 271/197

[58] Field of Search ..... 355/3 FU, 10; 219/216; 34/95, 236, 145, 155; 432/59, 60; 271/197

[56] References Cited

U.S. PATENT DOCUMENTS

| | | | |
|---|---|---|---|
| 3,827,855 | 8/1974 | Blake | 432/60 |
| 3,854,224 | 12/1974 | Yamaji et al. | 355/10 X |
| 3,878,622 | 4/1975 | Knechtel et al. | 34/95 |
| 3,902,845 | 9/1975 | Murphy | 432/60 |
| 3,991,483 | 11/1976 | Knechtel et al. | 34/95 |
| 4,285,507 | 8/1981 | Marinoff | 271/197 X |
| 4,462,675 | 7/1984 | Moraw et al. | 355/10 X |
| 4,520,048 | 3/1985 | Ranger | 427/350 |
| 4,538,899 | 9/1985 | Landa et al. | 355/3 FU |
| 4,545,671 | 10/1985 | Anderson | 355/3 SH |

FOREIGN PATENT DOCUMENTS

| | | |
|---|---|---|
| 156046 | 2/1985 | European Pat. Off. . |
| 54-153641 | 12/1979 | Japan . |
| 783746 | 11/1980 | U.S.S.R. . |

*Primary Examiner*—R. L. Moses

*Attorney, Agent, or Firm*—H. Fleischer; J. E. Beck; R. Zibelli

[57] ABSTRACT

A reproducing machine in which an electrostatic latent image recorder on a photoconductive member is developed with a liquid developer material comprising at least a liquid carrier having pigmented particles dispersed therein. The developed image is transferred from the photoconductive member to a sheet of support material. The sheet of support material, with the developed image thereon, passes through a housing. In the housing, heat and pressure are applied to the sheet of support material to vaporize the liquid carrier and to fuse the pigmented particles to the sheet of support material in image configuration. A substantially portion of the vaporized liquid carrier and heated air are removed from the interior of the housing.

12 Claims, 3 Drawing Sheets

LIQUID INK FUSING SYSTEM

LIQUID INK FUSING SYSTEM

This invention relates generally to an electrophotographic printing machine, and more particularly concerns fusing a liquid image to a copy sheet.

Generally, the process of electrophotographic printing includes charging a photoconductive member to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After the electrostatic latent image is recorded on the photoconductive member, the latent image is developed by bringing a liquid developer material into contact therewith. The liquid developer material comprises a liquid carrier having pigmented particles dispersed therein. The pigmented particles are deposited, in image configuration on the photoconductive member. Thereafter, the developed image is transferred to the copy sheet. Invariably, some of the liquid carrier is transferred along with the pigmented particles to the copy sheet. After transfer, heat is applied to the copy sheet to permanently fuse the pigmented particles to the copy sheet and vaporize the residual liquid carrier adhering thereto. Current fusing systems require large amounts of heat and high pressure to fuse the pigmented particles, and relatively high air flows to maintain the liquid carrier vapor levels at a safe operating condition, i.e. less than 25% of the lower explosion limit.

Numerous techniques have been developed for heating the developed image on the copy sheet to permanently fuse the pigmented particles thereto. Among these are oven fusing, hot air fusing, flash fusing and roll fusing. It has been found that roll fusing requires significantly lower energy requirements than radiant or oven fusing. Moreover, there is a reduced production of water vapor due to reducing the bulk heating of the copy sheet during the fusing of the pigmented particles thereto. In order to minimize environmental hazards and insure that the electrophotographic printing machine may be employed in an office environment, large amounts of vaporized liquid carrier cannot be vented to the atmosphere. Environmentally hazardous conditions arise when large amounts of vaporized liquid carrier is discharged to the atmosphere. The continuous replacement of liquid carrier significantly increases the cost of the printing machine. Thus, it is economically advantageous to re-use the liquid carrier rather than replacing the used liquid carrier with new liquid carrier. Hence, it is necessary to recover the vaporized liquid carrier prior to the discharge of the liquid carrier saturated air to the atmosphere. Hereinbefore, various techniques have been devised for fusing the liquid image to the copy sheet and recovering the vaporized liquid carrier. The following disclosures appear to be relevant:

U.S. Pat. No. 3,827,855, Patentee: Blake, Issued: Aug. 6, 1974; U.S. Pat. No. 3,902,845, Patentee: Murphy, Issued: Sept. 2, 1975; U.S. Pat. No. 4,520,048, Patentee: Ranger, Issued: Mar. 28, 1985; U.S. Pat. No. 4,545,671, Patentee: Anderson, Issued: Oct. 8, 1985; European Patent Publication No. 156,046, Published: Feb. 10, 1985, Inventor: Suzuki et al.

The relevant portions of the foregoing disclosures may be briefly summarized as follows:

Blake discloses a drum having a multiplicity of passageways for applying a vacuum. Toner is fixed to a sheet as it is held to the drum by the vacuum.

Murphy describes a heated fuser roll comprising a porous reservoir of offsetting material. The offsetting material diffuses during copier operation.

Ranger discloses an apparatus for applying a coating comprising a roll with a vapor permeable outer surface. The roll is adapted to be connected to a vacuum source. A permeable belt surrounded by vacuum boxes is provided in an alternative embodiment of the invention.

Anderson describes an apparatus for guiding and cooling a support as it exits from a heated fuser. A guide member is provided having vacuum opening to transfer heat from the copy sheet.

Suzuki et al. discloses a roller fixing device having a porous coating layer. The preferred coating material is polytetrafluoroethylene.

In accordance with one aspect of the present invention, there is provided a reproducing machine of the type having a latent image recorded on a member. Means are provided for developing the latent image recorded on the member with a liquid developer material comprising at least a liquid carrier having pigmented particles dispersed therein. Means transfer the developed image from the member to a sheet of support material. A housing is provided having sheet inlet and sheet outlet passageways therein. Means, disposed interiorly of the housing, advance the sheet from the inlet of the housing to the outlet thereof and apply heat and pressure to the sheet of support material having the developed image thereon to vaporize liquid carrier thereon and to fuse the pigmented particles to the sheet of support material in image configuration thereon. Means remove a substantial portion of the heated air and vaporized liquid carrier from the housing.

Pursuant to another aspect of the features of the present invention, there is provided an electrophotographic printing machine having a photoconductive member and means for recording an electrostatic latent image on the photoconductive member. Means develop the latent image recorded on the photoconductive member with a liquid developer material comprising at least liquid carrier having pigmented particles dispersed therein. Means transfer the developed image from the photoconductive member to a sheet of support material. A housing is provided having sheet inlet and sheet outlet passageways thereto. A housing is provided having sheet inlet and sheet outlet passageways therein. Means, disposed interiorly of the housing, advance the sheet from the inlet of the housing to the outlet thereof and apply heat and pressure to the sheet of support material having the developed image thereon to vaporize liquid carrier thereon and to fuse the pigmented particles to the sheet of support material in image configuration thereon. Means remove a substantial portion of the heated air and vaporized liquid carrier from the housing.

Other aspects of the present invention will become apparent as the following description proceeds and upon reference to the drawings, in which.

While the present invention will hereinafter be descried in conjunction with various embodiments thereof, it will be understood that it is not intended to limit the invention to these embodiments. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation descried briefly with reference thereto.

Figure 1:
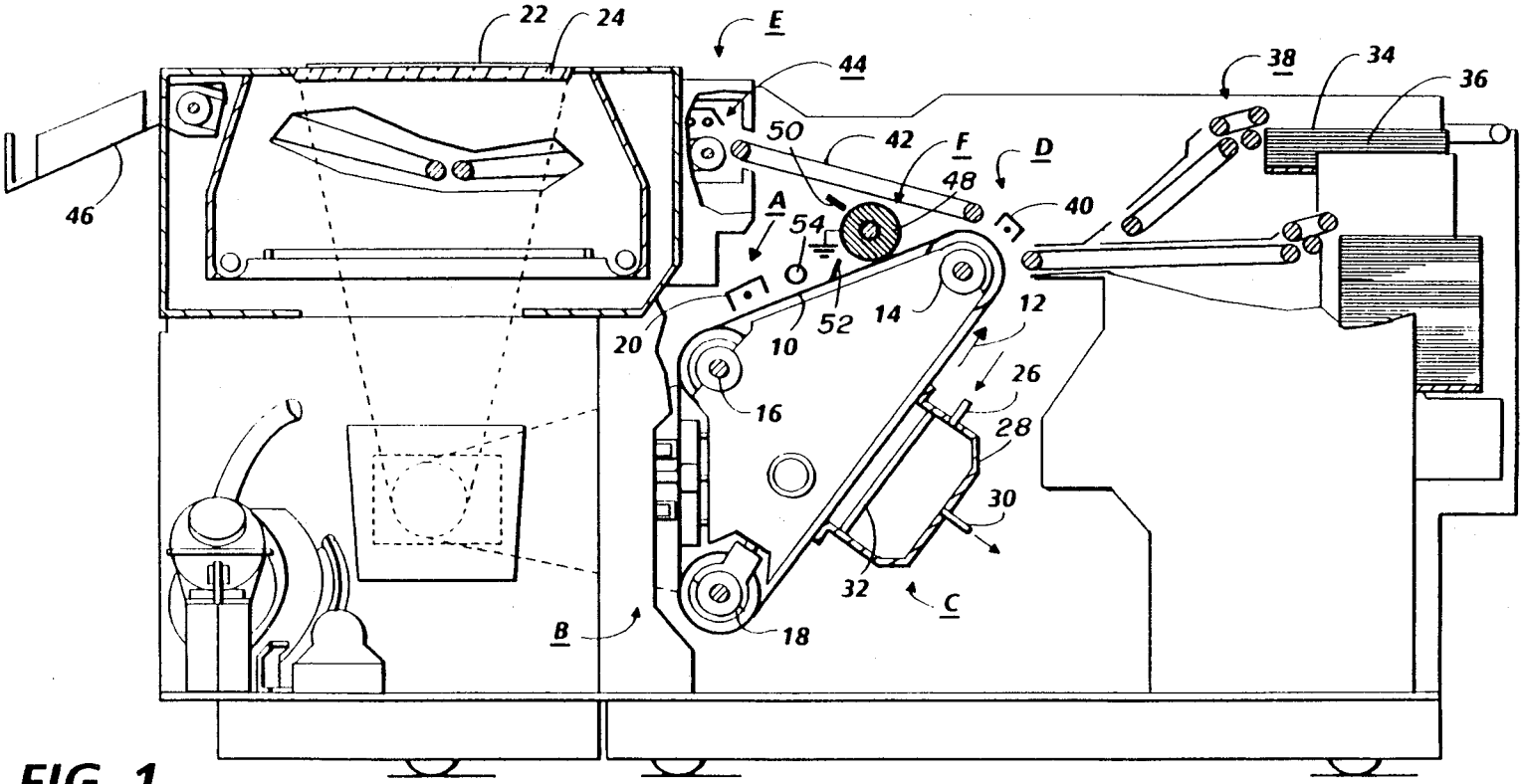
FIG. 1 is a schematic elevational view showing an illustrative electrophotographic printing machine incorporating the features of the present invention therein.

Turning now to FIG. 1, the electrophotographic printing machine employs a belt 10 having a photoconductive surface deposited on a conductive substrate. Preferably, the photoconductive surface is made from a selenium alloy with the conductive substrate being made from an electrically grounded aluminum alloy. Other suitable photoconductive surfaces and conductive substrates may also be employed. Belt 10 moves in the direction of arrow 12 to advance successive portions of the photoconductive surface through the various processing stations disposed about the path of movement thereof. Belt 10 is supported by three rollers 14, 16, and 18 located with parallel axes at approximately the apexes of a triangle. Roller 14 is rotatably driven by a suitable motor associated with a drive (not shown) to move belt 10 in the direction of arrow 12.

Initially, a portion of belt 10 passes through charging station A. At charging station A, a corona generating device, indicated generally by the reference numeral 20, charges the photoconductive surface of belt 10 to a relatively high, substantially uniform potential.

Next, the charged portion of the photoconductive surface is advanced through exposure station B. At exposure station B, an original document 22 is positioned face down upon a transparent platen 24. Lamps flash light rays onto original document 22. The light rays reflected from original document 22 are transmitted through a lens forming a light image thereof. The lens focuses the light image onto the charged portion of the photoconductive surface to selectively dissipate the charge thereon. This records an electrostatic latent image on the photoconductive surface corresponding to the informational areas contained within the original document. Thereafter, belt 10 advances the electrostatic latent image recorded on the photoconductive surface to development station C.

At development station C, a developing liquid comprising an insulating carrier liquid and toner particles, is circulated from any suitable source (not shown) through pipe 26 into development tray 28 from which it is withdrawn through pipe 30 for recirculation. Development electrode 32, which may be appropriately electrically biased, assists in developing the electrostatic latent image with the toner particles, i.e. the pigmented particles dispersed in the liquid carrier, as it passes in contact with the developing liquid. The charged toner particles, disseminated throughout the carrier liquid, pass by electrophoresis to the electrostatic latent image. The charge of the toner particles is opposite in polarity to the charge on the photoconductive surface. By way of example, if the photoconductive surface is made from a selenium alloy, the photoconductive surface will be positively charged and the toner particles will be negatively charged. Alternatively, if the photoconductive surface is made from a cadmium sulfide material, the photoconductive surface will be negatively charged and the toner particles will be positively charged. Generally, the amount of liquid carrier on the photoconductive surface is too great. A roller (not shown) whose surface moves in a direction opposite to the direction of movement of the photoconductive surface, is spaced from the photoconductive surface and adapted to shear excessive liquid from the developed image without disturbing the image.

After development, belt 10 advances the developed image to transfer station D. At transfer station D, a sheet of support material 34, i.e. a copy sheet, is advanced from stack 36 by a sheet feeder, indicated generally by the reference numeral 38. The sheet of support material advances in synchronism with the movement of the developed image on belt 10 so as to arrive simultaneously therewith at transfer station D. Transfer station D includes a corona generating device 40 which sprays ions onto the backside of the copy sheet. This attracts the developed image from the photoconductive surface to the copy sheet. After transfer, the copy sheet continues to move onto conveyor 42 which advances the sheet to fusing station E.

Fusing station E includes a fusing system indicated generally by the reference 44. The fuser assembly vaporizes the liquid carrier from the copy sheet and permanently fuses the toner particles in image configuration thereto. The detailed structure of fusing system 44 will be described hereinafter with reference to FIGS. 2 through 4, inclusive. After fusing, the copy sheet is advanced to catch tray 46 for subsequent removal from the printing machine by the operator.

After the copy sheet is separated from the photoconductive surface of belt 10, some residual liquid developer material remains adhering thereto. This residual developer material is removed from the photoconductive surface at cleaning station F. Cleaning station F includes a cleaning roller 48, formed of any appropriate synthetic resin driven in a direction opposite to the direction of movement of the photoconductive surface to scrub the photoconductive surface clean. To assist in this action, developing liquid may be fed through pipe 50 onto the surface of cleaning roller 48. A wiper blade 52 completes the cleaning of the photoconductive surface. Any residual charge left on the photoconductive surface is extinguished by flooding the photoconductive surface with light from lamp 54.

Preferably, the developer material includes a liquid insulating carrier having pigmented particles, i.e. toner particles dispersed therein A suitable insulating liquid carrier may be made from aliphatic hydrocarbon, such as an Isopar, which is a trademark of the Exxon Corporation, having a low boiling point. The toner particles include a pigment, such as carbon black, associated with the polymer. A suitable liquid developer material is described in U.S. Pat. No. 4,582,774, issued to Landa in 1986, the relevant portions thereof being incorporated into the present application.

It is believed that the foregoing description is sufficient for purposes of the present application to illustrate the general operation of an electrophotographic printing machine incorporating the features of the present invention therein.

Figure 2:
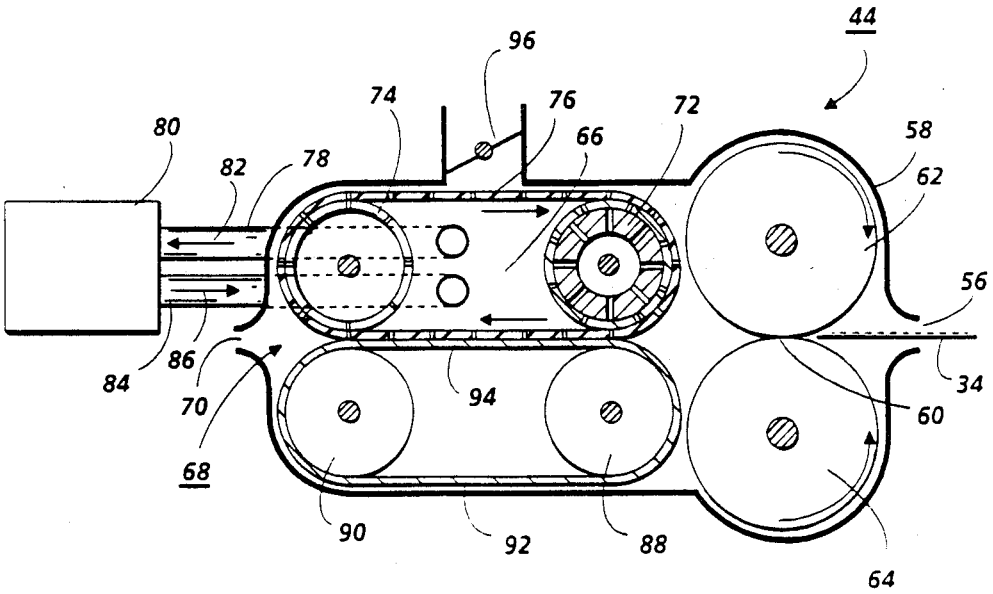
FIG. 2 is an elevational view depicting one embodiment of a fusing system used in the FIG. 1 printing machine.

Referring now to FIG. 2, there is shown fuser system 44 in greater detail. As depicted thereat, a copy sheet 34 advances into entrance passageway 56 of housing 58. The copy sheet then advances into nip 60 defined by fuser roller 62 and back-up pressure roller 64. Rollers 62 and 64 are resiliently urged into engagement with one another to define nip 60. Preferably, back-up roller 64 includes a rigid internal core which may be steel, over which is a sleeve-like cover of flexible material having non-stick properties such as Teflon. Fuser roller 62 similarly has a rigid internal core which may be steel, having a relatively thick sleeve-like covering thereover. The fuser roller sleeve is comprised of a flexible material, such as Silicone rubber. To heat fuser roller 62, a lamp is disposed within the fuser roller core. The core has a suitable opening for receipt of the lamp. In this arrangement, heat energy from the lamp permeates through the metal core and the outer sleeve to heat the surface of fuser roller 62 to the requisite temperature required to fuse the pigmented particles on the copy sheet. The liquid carrier material on the copy sheet is vaporized. Preferably, fuser roller 62 and pressure roller 64 apply from between 50 to 150 pounds per square inch of pressure on the copy sheet with the copy sheet being heated from about 210° F. to about 280° F. (100° C. to about 140° C.). At these temperatures and pressures, the toner particles are fused to the copy sheet and the liquid carrier vaporized. As shown in FIG. 2, fuser roller 62 and pressure roller 64 are disposed in chamber 66 of housing 58. An air pervious conveyor, indicated generally by the reference numeral 68, advances the copy sheet from nip 60 to the exit passageway 70 for subsequent advancement to catch tray 46 (FIG. 1). Conveyor 68 includes a pair of spaced apart rollers 72 and 74. Roller 72, positioned in the region of fuser roller 62, is porous. Roller 72 includes a multiplicity of openings from the exterior surface thereof to the interior so as to achieve the desired degree of porosity. An upper belt 76 is entrained about rollers 72 and 74. Upper belt 76 has a multiplicity of openings therein to achieve the requisite porosity. Conduit 78 is connected to housing 58 and located in the interior portion of belt 76. Conduit 78 connects the interior portion of belt 76 to condenser 80. Condenser 80 has a blower associated therewith so as to remove vaporized liquid carrier and heated air from chamber 66. The blower maintains chamber 66 of housing 58 at a negative pressure with respect to atmospheric pressure. The heated air and vaporized liquid carrier flow through conduit 78 in the direction of arrow 82 to condenser 80. Conduit 84 also couples condenser 80 to the interior region of belt 76 of chamber 66. Cool air flows through conduit 84, in the direction of arrow 86, to chamber 66 interior of belt 76. The air flowing from conduit 84 to chamber 66 interior of belt 76 cools belt 76 so as to help cool the sheet of support material 34 exiting from fuser roller 62 and back-up roller 64. In this manner, sheet 34 is cooled by air flowing from conduit 84. The air flowing from conduit 84 is directed to chamber 66 interior of belt 76 and does not cool fuser roller 62. Conveyor 68 also includes a second pair of spaced apart rollers 88 and 90 having a lower belt 92 entrained thereabout. Belt 92 engages belt 76 to define a nip 94 through which sheet 34 passes after the image has been fused thereto. A drive motor suitably coupled to rollers 74 and 90 rotate these rollers. Conveyor 66 advances sheet 34 from nip 60 to exit 70 of housing 58. The negative pressure maintained in the interior of belt 76 aids in the vaporization of the liquid carrier. Valve 96 controls the addition of exterior air to chamber 66. Valve 96 permits sufficient exterior air to be added to chamber 66 so as to insure that the concentration of liquid carrier vapors is below the lower explosion limit.

Figure 3:
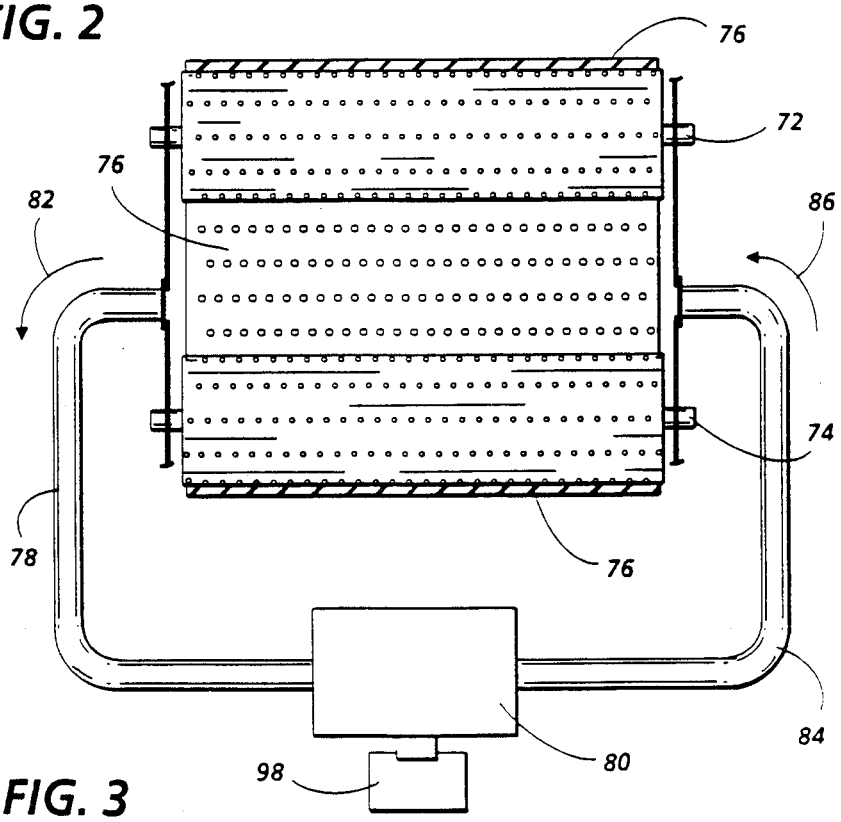
FIG. 3 is a plan view showing a portion of the FIG. 2 system.

Referring now to FIG. 3, there is shown the solvent recovery system which includes condenser 80 coupled by conduits 78 and 84 to chamber 66 in the interior of belt 76. A blower produces a flow of heated air and vaporized liquid carrier from chamber 66 though conduit 78 to condenser 80. The liquefied carrier is collected in container 98 and the cooled air returned, via conduit 84, to chamber 66 in the interior of belt 76. This cool air aids in cooling sheet 34 without cooling fuser roller 62.

Figure 4:
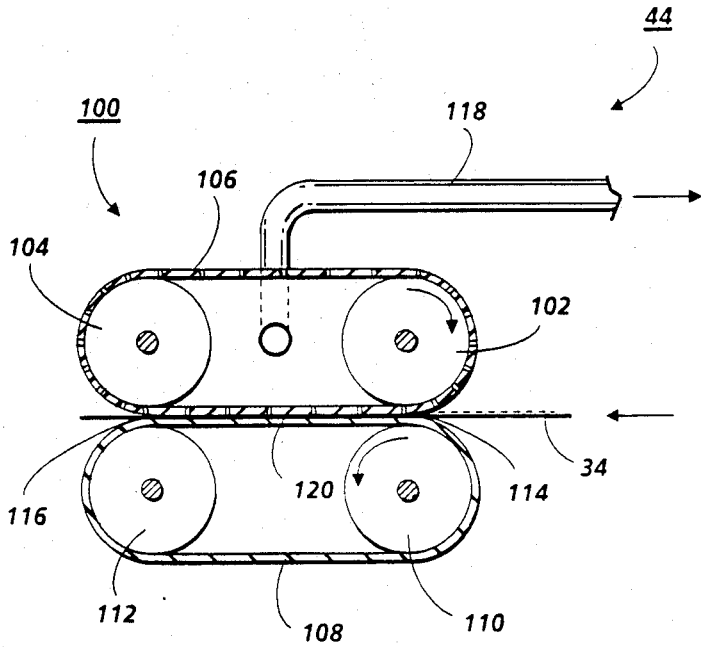
FIG. 4 is an elevational view depicting another embodiment of the fusing system used in the FIG. 1 printing machine.

Turning now to FIG. 4, there is shown another embodiment of fusing system 44. As shown in FIG. 4, an air pervious, heated conveyor 100 receives the copy sheet 34 with the liquid image transferred thereto. Conveyor 100 includes a pair of spaced rollers 102 and 104. A porous upper belt 106 is entrained about rollers 102 and 104. Belt 106 has a multiplicity of holes therein to achieve the desired degree of porousity. Roller 102 is heated so as to heat belt 106. By way of example, roller 102 can be constructed in the same manner as fuser roller 62. Conveyor 100 also includes a lower belt 108 entrained about a pair of spaced apart rollers 110 and 112. Roller is resiliently urged in an upward direction to press lower belt 108 against upper belt 106 in entrance region 114. Roller 112 presses lightly against lower belt 108 in exit region 116 so that the pressure between belt 106 and belt 108 progressively decreases along belts 106 and 108 from rollers 102 and 110 to rollers 104 and 112. In this way, a nip 120 is defined by belts 106 and 108 which applies heat and pressure to the copy sheet being advanced therealong. Conveyor 100 is positioned in the chamber of a housing. Conduit 118 is connected to the housing in the region of the interior of belt 106 so as to maintain the chamber at a negative pressure and remove the vaporized liquid carrier therefrom. Belt 106 may be slightly stretched to minimize clogging of the holes therein. Preferably, rollers 104 and 112 are driven by a drive motor suitably coupled thereto.

In recapitulation, it is clear that the fusing system of the present invention advances the copy sheet and permanently fuses pigmented particles thereto in image configuration while collecting the vaporized liquid carrier in a container. The collected liquid carrier may be recycled to the development system for subsequent reuse in the printing machine.

It is, therefore, evident that there has been provided in accordance with the present invention, a fusing system that fully satisfies the aims and advantages heretofore mentioned. While this invention has been described in conjunction with various embodiments, it is evident that many alternatives, modifications and variations will be apparent to those skilled in the art. Accordingly, it is intended to embrace all such alternatives, modifications and variations that fall within the spirit and broad scope of the appended claims.

I claim:

1. A reproducing machine of the type having a latent image recorded on a member, wherein the improvement includes:

means for developing the latent image recorded on the member with a liquid developer material comprising at least a liquid carrier having pigmented particles dispersed therein;

means for transferring the developed imaged from the member to a sheet of support material;

a housing having sheet inlet and sheet outlet passageways therein;

a pressure roll;

a heated roll cooperating with said pressure roll to form a nip for advancing the sheet of support material therethrough from the inlet of said housing so as to vaporize liquid carrier from the sheet of support material and to heat the pigmented particles to fuse the pigmented particles to the sheet of support material in image configuration;

an air pervious conveyor, disposed interiorly of said housing, arranged to advance the sheet of support material having the fused image from the nip defined by said heated roll and said pressure roll to the outlet of said housing said conveyor includes a first pair of spaced rollers with one of said first pair of rollers being positioned in the region of said heated roll and being air pervious, and an upper belt having a multiplicity of apertures therein entrained about said pair of rollers;

means for removing a substantial portion of the heated air and vaporized liquid carrier from said housing; and means, in communication with the interior of said housing, for cooling the heated air and vaporized liquid carrier removed from said housing to condense the vaporized liquid carrier wherein the cooled air from said cooling means is returned to the interior of said housing to aid in cooling the sheet of support material without substantial cooling of said heated roll.

2. A reproducing machine according to claim 1, wherein said conveyor includes:

a second pair of spaced rollers with one of said second pair of rollers being positioned in the region of said pressure roll; and a lower belt entrained about said second pair of rollers, said upper belt and said lower belt cooperating with one another to define a nip for advancing the sheet of support material from the nip defined by said heated roll and and pressure roll to the outlet of said housing.

3. A reproducing machine according to claim 2, further including means, associated with said cooling means, for collecting the liquefied liquid carrier.

4. A reproducing machine according to claim 1, wherein said advancing and applying means includes a heated, air pervious conveyor arranged to advance the sheet of support material from the inlet of said housing to the outlet thereof so as to vaporize liquid carrier from the sheet of support material and to heat the pigmented particles to fuse the pigmented particles to the sheet of support material in image configuration.

5. A reproducing machine according to claim 4, wherein said conveyor includes:

a first pair of spaced rollers; and a heated upper belt having a multiplicity of apertures therein entrained about said pair of rollers.

6. A reproducing machine according to claim 5, wherein said conveyor includes:

a second pair of spaced rollers; and a lower belt entrained about said second pair of rollers, said upper belt and said lower belt cooperating with one another to define a nip for advancing the sheet of support material from the inlet of said housing to the outlet of said housing.

7. An electrophotographic printing machine, including:

a photoconductive member;

means for recording an electrostatic latent image on said photoconductive member;

means for developing the latent image recorded on said photoconductive member with a liquid developer material comprising at least a liquid carrier having pigmented particles dispersed therein;

means for transferring the developed imaged from said photoconductive member to a sheet of support material;

a housing having sheet inlet and sheet outlet passageways therein;

a pressure roll;

a heated roll cooperating with said pressure roll to form a nip for advancing the sheet of support material therethrough from the inlet of said housing so as to vaporize liquid carrier from the sheet of support material and to heat the pigmented particles to fuse the pigmented particles to the sheet of support material in image configuration;

an air pervious conveyor, disposed interiorly of said housing, arranged to advance the sheet of support material having the fused image from the nip defined by said heated roll and said pressure roll to the outlet of said housing said conveyor includes a first pair of spaced rollers with one of said first pair of rollers being positioned in the region of said heated roll and being air pervious, and an upper belt having a multiplicity of apertures therein entrained about said pair of rollers;

means for removing a substantial portion of the heated air and vaporized liquid carrier from said housing; and means, in communication with the interior of said housing, for cooling the heated air and vaporized liquid carrier removed from said housing to condense the vaporized liquid carrier wherein the cooled air from said cooling means is returned to the interior of said housing to aid in cooling the sheet of support material without substantial cooling of said heated roll.

8. A printing machine according to claim 7, wherein said conveyor includes:

a second pair of spaced rollers with one of said second pair of rollers being positioned in the region of said pressure roll; and a lower belt entrained about said second pair of rollers, said upper belt and said lower belt cooperating with one another to define a nip for advancing the sheet of support material from the nip defined by said heated roll and and pressure roll to the outlet of said housing.

9. A printing machine according to claim 8, further including means, associated with said cooling means, for collecting the liquefied liquid carrier.

10. A printing machine according to claim 7, wherein said advancing and applying means includes a heated, air pervious conveyor arranged to advance the sheet of support material from the inlet of said housing to the outlet thereof so as to vaporize liquid carrier from the sheet of support material and to heat the pigmented particles to fuse the pigmented particles to the sheet of support material in image configuration.

11. A printing machine according to claim 10, wherein said conveyor includes:

a first pair of spaced rollers; and a heated upper belt having a multiplicity of apertures therein entrained about said pair of rollers.

12. A printing machine according to claim 11, wherein said conveyor includes:

a second pair of spaced rollers; and a lower belt entrained about said second pair of rollers, said upper belt and said lower belt cooperating with one another to define a nip for advancing the sheet of support material from the inlet of said housing to the outlet of said housing.

* * * * *